United States Patent [19]

der Kinderen, deceased et al.

[11] Patent Number: 4,847,534

[45] Date of Patent: Jul. 11, 1989

[54] HIGH-PRESSURE DISCHARGE LAMP WITH TORSIONALLY WOUND ELECTRODE STRUCTURE

[75] Inventors: Wilhelmus C. der Kinderen, deceased, late of Veldhoven; by Friedrich J. De Haan, administrator, Dommelen, both of Netherlands

[73] Assignee: U.S. Philips Corporation, New York, N.Y.

[21] Appl. No.: 884,692

[22] Filed: Jul. 11, 1986

[30] Foreign Application Priority Data

Jul. 17, 1985 [NL] Netherlands ..... 8502054

[51] Int. Cl.[4] ..... H01J 61/06; H01J 61/073

[52] U.S. Cl. ..... 313/628; 313/631; 313/344; 445/46; 445/51; 140/71.5

[58] Field of Search ..... 313/628, 631, 633, 344, 313/575, 576; 445/46, 50, 51; 140/71.5

[56] References Cited

U.S. PATENT DOCUMENTS 3,132,409 5/1964 Freeman ..... 313/628 X
3,170,081 2/1965 Rokosz ..... 313/631
4,150,317 4/1979 Laska et al. ..... 313/631
4,319,158 3/1982 Watanabe et al. ..... 313/633 X
4,559,473 12/1985 McVey ..... 313/631 X

FOREIGN PATENT DOCUMENTS 2043331 10/1980 United Kingdom .

*Primary Examiner*—Leo H. Boudreau
*Assistant Examiner*—Michael Horabik
*Attorney, Agent, or Firm*—Brian J. Wieghaus

[57] ABSTRACT

The high-pressure gas discharge lamp according to the invention has electrodes comprising a rod of mainly tungsten and a helical winding of mainly tungsten near the tip of the rod. The winding has a first layer of turns, which is integral with a second layer of turns. The turns of the second layer are wound with torsion in the wire and surround turns of the first layer which are also wound with torsion. The direction of the torsion in a turn is equal to the direction in which the turn extends around the rod. As a result, the turns with torsion surround with tight fit their substrate and the winding is securely fixed ot the electrode rod.

11 Claims, 1 Drawing Sheet

HIGH-PRESSURE DISCHARGE LAMP WITH TORSIONALLY WOUND ELECTRODE STRUCTURE

BACKGROUND OF THE INVENTION

The invention relates to a high-pressure gas discharge lamp comprising a translucent lamp vessel, which is sealed in a vacuumtight manner, which is filled with an ionizable gas and which has electrodes which project into the lamp vessel and are connected to current supply conductors, which extend to the exterior through the wall of the lamp vessel, the electrodes each comprising a rod of mainly tungsten, which has near its tip projecting inside the lamp vessel a helical winding of wire of mainly tungsten, a first layer of turns being present around the rod and a second layer of turns being arranged to surround the first layer, this winding being fixed on the rod and the wire of this winding having ends with end faces.

Such a lamp is known from U.S. Pat. No. 3,170,081.

The winding around the rod of an electrode solely has for its object to obtain a satisfactory temperature variation over the electrode, or additionally to hold electron-emitting material.

It is mostly necessary for the winding to be fixed on the rod, for example, by deforming a turn in the hot state or by ensuring that the latter is clamped around the rod, or by welding the winding to the rod.

In the lamp according to the said U.S. Pat. No. 3,170,081, the first layer of turns is a body which is slipped with clearance around the rod and is fixed on it, while the other layer of turns is a separate body which is slipped around the first layer. In order to fix the second layer of turns, the first layer of turns has a projecting wire portion at its end remote from the tip of the rod of the electrode and the other layer of turns has at the corresponding end a wire portion bent towards the rod. This electrode construction renders the manufacture of the electrodes and hence of the lamp difficult. The invention has for its object to provide a high-pressure gas discharge lamp of the kind mentioned, whose electrodes have simple construction that can be readily manufactured, while nevertheless the winding is firmly fixed on the rod.

SUMMARY OF THE INVENTION

According to the invention, this object is achieved in a highpressure gas discharge lamp of the kind described in the opening paragraph in that the first layer of turns is integral with the second layer of turns, in that turns of the second layer are wound with torsion in the wire and surround turns of the first layer, which are also wound with torsion in the wire, and in that the torsion in the wire of each turn with torsion has the same direction as the direction in which the relevant turn extends around the rod of the electrode.

In contrast with electrodes according to the said U.S. Pat. No. 3,170,081, in which the electrodes are assembled from separately manufactured bodies, the electrodes of the lamp according to the invention are obtained by manufacturing the winding on the rod of the electrode itself as a winding mandrel. During the manufacture of the electrodes, an assembling step is thus omitted, which is especially advantageous when the electrodes, the rods and the windings are small and hence vulnerable. Furthermore, a separate step for fixing the winding is omitted. Nevertheless, the winding of the electrode is firmly fixed.

The fixing of the winding on the rod of the electrode will now be explained. When a wire is wound around mandrel (rod), the turns of this wire tend to assume a larger diameter. In the case of a circular mandrel, this larger turn diameter is in fact obtained in that the wire can move tangentially along the mandrel. This also applies to a seocnd layer of turns, which is disposed on a first layer of turns if this second layer is wound in the same directions as the first layer. Also in this case, the "mandrel", i.e. the rod onto which the first layer was wound together with this first layer, is circular. When this second layer of turns is wound in the opposite direction, the "mandrel" behaves as not perfectly round because the turns of this second layer each time have to jump over the turns of the first layer, but the "out-of-roundness" of the "mandrel" is very small. The deviation from the circular form only has the size of a fraction of the wire diameter, while the "mandrel" diameter is comparatively large, i.e. equal to the diameter of the rod onto which there is wound plus twice the wire diameter. Due to this small out-of-roundness, the wire also in this case can move tangentially, as a result of which the turns assume a larger diameter and the layers become detached.

The invention is based on the recognition of the fact that the "out-of-roundness" of a rod surrounded by a first layer of turns is sufficiently large for a second layer of turns wound in opposite direction around the first layer to prevent the wire from moving tangentially if the second layer is wound very tautly around the first layer. When the first layer of turns is wound tautly around the electrode rod and is integral with this second layer of turns, the winding around the rod of the electrode is fixed on this rod. The turns of the first layer surrounded by the second layer can then in fact not be relieved by moving tangentially. In order to be able to wind so tautly that such a fixing is attained, however, a very large winding force is required in the wire. As a result, the wire is liable to break during winding.

The invention is further based on the recognition of the fact that there can be wound with a tensile force in the wire which is much smaller than the breaking force in the wire, and that nevertheless the winding is fixed on the rod of the electrode, if the wire has a torsion in the correct direction during winding.

In the case of torsion in the wire, the wire tends after winding to be deformed in such a manner that the torsional stress is reduced. In the case of torsion in the correct direction, this deformation results in that the turns assume a larger relative distance so that they are located more tautly around the "winding mandrel". For the first layer of turns, the "winding mandrel" is the rod of the electrode, while for the second layer of turns this mandrel is that rod plus the first layer of turns.

The correct direction of torsion for the wire is obtained during and also after winding if the torsion in the wire of the turn has the same direction as the direction in which the relevant turn extends around the rod of the electrode. These terms are explained as follows.

The direction in which turns extend around the rod of an electrode is determined by looking along the axis of the rod from the first turn of the layer to the last turn of this layer. A turn (the wire) then extends in a clockwise direction (to the right) or in counterclockwise direction (to the left) around the rod.

The direction in which the wire is twisted during (and after) winding is determined by looking along the axis of the wire to the rod. The wire is then twisted near the observer about its axis in clockwise direction (to the right) or in counterclockwise direction (to the left). Due to the fact that the wire of mainly tungsten is obtained by drawing a thicker wire through a drawing die, such a wire has in its surface drawing grooves, which extend in the axial direction of the wire. In the case of a twisted wire, the drawing grooves extend at an angle to the axial direction of the wire. In the case of torsion of the wire in clockwise direction, the drawing grooves consequently extend in the counterclockwise direction away from the said observer looking at the torsion around the wire.

Besides the advantage that the electrodes of the lamp according to the invention need not be assembled from mostly vulnerable parts and that during their manufacture no separate fixing step need be carried out, the electrodes have the advantage that there is a very good and reproducible thermal contact between the rod and its winding.

The extent of torsion produced in the wire is connected with the requirements imposed on the fixing of the winding on the rod. However, in a particular case, said extent can be readily determined in a few experiments. It should be noted that, if the first layer of turns is provided with a smaller torsion per turn, a slightly larger torsion per turn is desirable in the second layer of turns because this second layer is wound on a thicker "mandrel" than the first layer.

The electrode and hence the high-pressure gas discharge lamp can be even more readily manufactured if the wire end of the winding of the rod of the electrode has a rupture surface. Such a rupture surface is obtained in that, after the step of helically winding is accomplished, the remaining wire portion not helically wound is severed from the winding by applying a tension force so that the breaking or rupture stress of the wire is exceeded. The wire then breaks at the area at which it loses its contact with the electrode.

Rupture surfaces have a characteristic appearance, as a result of which they can be readily recognized as such by those skilled in the art. They have a rough surface, which is dull due to its roughness. They are further devoid of tracks, such as grooves or a burr, which are left in or at a separation surface by cutting-, pinching-, clipping- or grinding tools.

When the wire is severed by a tension force, a plastic deformation is produced. Mostly, a reduction of the diameter of the wire is obtained near the rupture surface. This reduction can be increased by heating the wire to a temperature between 800° and 850° C. prior to winding. Another consequence of the plastic deformation is that the wire at least substantially follows the surface of the "mandrel" around which it is wound as far as the rupture surface, and that the wire does not or substantially does not project beyond the sheath of the winding.

During the manufacture of the winding around the rod of the electrode, the beginning part of the wire is held in a clamp; when the winding is finished, this beginning part can be severed in a corresponding manner by applying a tension force so that the rupture or breaking stress is exceeded.

An electrode having a winding with a rupture surface at least at the wire end of the second layer of turns has the advantage of a simple manufacture without the necessity of using tools for clipping, pinching, grinding or cutting, in which operations burrs are substantially always formed. With such tools, the electrode moreover cannot be approached very closely, the less so if the winding should not be damaged, so that during pinching, clipping, grinding or cutting, the ends of the winding project beyond the sheath of the winding. This may be disadvantageous.

The lamp according to the invention may be a high-pressure sodium lamp provided with a ceramic lamp vessel of, for example, (polycrystalline) alumina or (monocrystalline) sapphire, or a high-pressure mercury discharge lamp that may contain metal halide and comprises a ceramic or quartz glass lamp vessel.

It should be noted that British Patent Specification No. 2,043,331 (GE Oct. 1, 1982) discloses electrodes for discharge lamps, in which the electrode rod has a helical winding of a single layer of turns. The turns are made of comparatively thick tungsten wire, around which wire is wound with a high pitch of a comparatively thin tungsten wire. The thin wire seves as a spacer both for the turns of the thick wire with respect to each other and for the turns of this wire and the rod. Consequently, a very open winding is obtained. With this electrode, the winding is separately manufactured and is then screwed around the electrode rod.

Torsion may occur in the turns of the thick wire of said known electrode. However, this torsion does not serve to fix the winding on the electrode rod and cannot be used for this purpose either. In fact the torsion has a sense opposite to that of the electrode of the lamp according to the invention. Due to this opposite sense, the turns do not tend to move away from each other and to be more tautly wound around the mandrel (as in the lamp according to the invention), but they tend to be pressed laterally firmly against each other and to be detached from the mandrel, as a result of which the wound wire has a high rigidity even if it is not supported by the electrode rod. In the lamp according to the invention, such a torsion would just result in that the winding would be loosely disposed around the electrode rod.

BRIEF DESCRIPTION OF THE DRAWINGS

Embodiments of the lamp according to the invention are shown in the drawing. In the drawing.

DETAILED DESCRIPTION OF THE INVENTION

Figure 1:
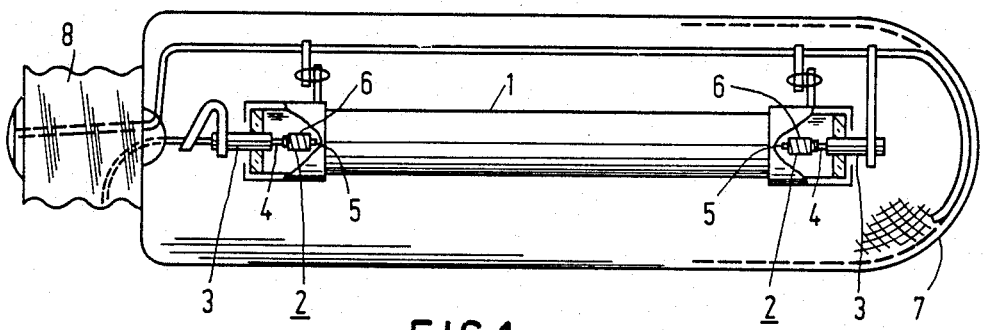
FIG. 1 is a developed side elevation of a high-pressure sodium discharge lamp with diagrammatically indicated electrodes.

The high-pressure sodium discharge lamp shown in FIG. 1 has a translucent lamp vessel 1 of mainly alumina, which is sealed in a vacuum-tight manner and has an ionizable filling of sodium, mercury and xenon. Electrodes 2 project into the lamp vessel 1 and are connected to current supply conductors 3, which extend to the exterior through the wall of the lamp vessel. The electrodes 2 each comprise a rod 4 of mainly tungsten, which has at its tip 5 projecting inside the lamp vessel a helical winding 6 of wire of mainly tungsten. of the helical winding 6 a first layer of turns is disposed around the rod 4 and a second layer of turns integral with it is arranged to surround the first layer of turns. The winding 6 is fixed on the rod 4. The discharge vessel 1 is arranged in an outer bulb 7, which is sealed in a vacuum-tight manner and has lamp cap 8. The electrodes are described more fully with reference to FIG. 3.

Figure 2:
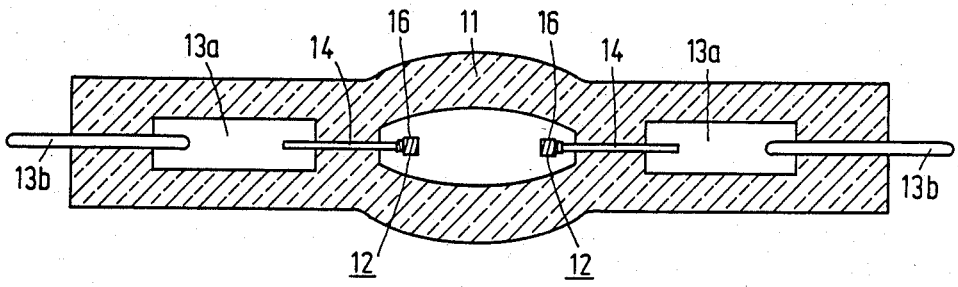
FIG. 2 shows in longitudinal sectional view a high-pressure mercury discharge lamp with diagrammatically indicated electrodes.

The high-pressure mercury discharge lamp shown in FIG. 2 has a quartz glass lamp vessel 11 which is sealed in a vacuum-tight manner and has an ionizable filling of argon, mercury, sodium-, scandium- and thallium-iodide. Electrodes 12, which are connected to current supply conductors 13*a*, 13*b* projecting beyond the lamp vessel 11, project into the lamp vessel 11. They each comprise an electrode rod 14 of mainly tungsten, which has near its tip projecting inside the lamp vessel 11 a helical winding 16 of wire of mainly tungsten. Of the helical winding 16 a first layer of turns is disposed around the rod 14 and another layer of turns is arranged to surround the first layer of turns so as to be integral with it. The winding 16 is fixed on the rod 14. The electrodes 12 are described more fully with reference to FIG. 3.

Figure 3:
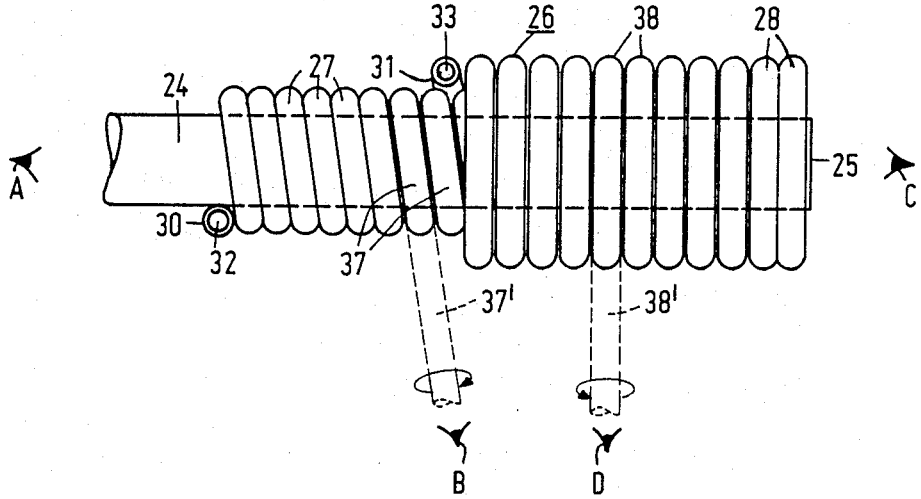
FIG. 3 is a side elevation of an electrode.

In FIG. 3, the electrode rod 24 of mainly tungsten has near its tip 25 a helical winding 26 of mainly tungsten. In this embodiment, there is disposed on the electrode rod 24 a first layer of turns 27, 37 of which the beginning part of the first turn is denoted by reference numeral 30, Viewed from the point A in the axial direction of the rod 24, the turns 27,37 extend in clockwise direction (to the right) around the rod 24. The turns 27 and 37 are made so as to have a pitch equal to the wire diameter. The turns 27 consequently engage each other laterally. A torsion in the clockwise direction is produced in the turns 37. In a stage of the manufacture of the electrode, the winding wire indicated by 37' extends along the front side to the rod 24. For the observer B, looking along the axis for the winding wire 37' towards the rod 24, the winding wire 37' was twisted near this observer in the clockwise direction (to the right). The torsion in the turns 37 therefore has the same direction as the direction in which the turns 37 extend around the rod 24. Drawing grooves in the wire consequently extend away from the observer B in counterclockwise direction around the wire 37'. Although this is not visible in the Figure, the process of winding with torsion is continued to the next to the last turn of the first layer of turns 27,37. The last two turns near the tip 25 are wound without producing torsion therein. The Figure indicates that the turns 37 are laterally disengaged from each other. This is a consequence of the torsion in the turns 37.

At the tip 25 of the electrode rod, the last turn of the first layer of turns 27,37 passes into the second layer of turns 28,38 as a result of which these two layers are integral with each other.

The first two turns 28 of the second layer of turns 28,38 are made without producing torsion therein. At the passage from the first layer of turns 27,37 to the second layer of turns 28,38 the winding sense or direction has become opposite to the original winding sense or direction. To the observer C looking along the axis of the rod 24 from the first turn 28 of the second layer of turns 28,38 to the end 31 of the last turn 38, the turns 28,38 extend in counterclockwise direction (to the left) aroudn therod 24. The turns 38 were wound with torsion in the wire, as a result of which they were laterally disengaged from each other. In a stage of the manufacture of the electrode, the winding wire denoted by 38' extended along the front side to the electrode rod 24. For the observer D, which looked along the axis of the winding wire 38' towards the electrode rod, the wire had in his proximity a torsion in counterclockwise direction (to the left). The torsion of the turns 38 consequently has the same direction as the direction in which the turns 38 extend around the rod 24.

Due to the torsion in the runs 37, these turns surround the rod 24 with clamping fit. For the turns 28,38 which are wound in opposite sense, the "mandrel" (24+27,37) is slightly out-of-round because of the first winding layer. The turns with torsion 38 surround with clamping fit this out-of-round "mandrel" (24+37), as a result of which the out-of-roundness is sufficient to prevent a tangential movement of the turns 38. The turns 37 disposed below the turns 38 also cannot be relieved, but surround the rod 24 with clamping fit. As a result, the winding 26 is fixed on the rod 24.

After the last turn 38 had been made, the remaining non-wound wire portion was severed by applying a tension force so that the breaking stress of the wire is exceeded. At this last turn an end 31 having a diameter smaller than the wire has elsewhere and a rupture surface 33 are formed. During winding, the beginning part of the wire is held in a clamp. After the winding 26 was finished, the excess wire at the beginning part was severed off. A winding end 30 having a smaller diameter and a rupture surface 32 were then formed.

In a 30 W metal halide lamp as shown in FIG. 2, electrodes as shown in FIG. 3 were used. The rod had a diameter of 140 μm and a wire having a diameter of 50 μm was wound onto it over a length of about 1 mm. Both parts consisted of tungsten containing 1.5% by weight of $ThO_2$. The winding was made with a winding force of 0.6N. Before winding, the wire was stretched by heating it at 850° C. Twisted turns in the first layer of turns had a torsion of 180° per turn in clockwise direction, while twisted turns in the second layer of turns had a torsion or 360° in counterclockwise direction. The beginning part of the wire and the remaining non-wound wire portion were torn off with a force of 5N. The winding force consequently was only a fraction of the tearing force.

Winding the electrode wire around the electrode rod in the above fashion simplifies manufacturing while maintaining a secure fit between the electrode windings and electrode rod. While it is deemed necessary that at least a force of 7N is required to push a winding off a rod, in this 30 W lamp the windings could not be slipped of the electrode rods with a force of 30N. This situation did not change after the electrodes had been heated in a vacuum at 2500° C. in order to clean them.

What is claimed is:

1. A high pressure discharge lamp, comprising:

(a) an outer envelope;

(b) a translucent discharge vessel containing an ionizable gas;

(c) current supply conductors;

(d) electrodes connected to said current-supply conductors which project into said discharge vessel so that during lamp operation an arc is established between said electrodes, said electrodes comprising a wire coil having a plurality of layers disposed around an electrode rod, a first layer having turns which are wound with torsion, the torsion having the same direction as the direction in which the torsioned turns extend around said electrode rod so that said torsioned turns have a clamping fit with said electrode rod, and successive layers having turns which are wound in a direction opposite to the direction of the turns in the preceding layer, each successive layer having turns which are wound with torsion, the torsion of each successive layer having the same direction as the direction in which said torsioned turns of each successive layer extend around the electrode rod so that said torsioned turns of each successive layer provide a clamping fit between said torsioned turns of each successive layer and the preceding layer.

2. A lamp as claimed in claim 1 wherein for each succeeding layer the amount of torsion in each torsioned turn is greater than the torsion in the torsioned turns in the preceding layer.

3. A lamp as claimed in claim 2 wherein each layer has ends bounded by outermost turns and the two outermost turns at each end of each layer are wound without torsion.

4. A lamp as claimed in claim 3 wherein said electrode rod comprises mainly tungsten and said wire coil comprises mainly tungsten.

5. A lamp as claimed in claim 5 wherein the outermost layer has an end with an end face and said end face is a rupture surface.

6. A lamp as claimed in claim 1 wherein said electrode coil is comprised of a plurality of wire pieces.

7. A lamp as claimed in claim 1 wherein each layer of said electrode coil is comprised of a separate wire piece.

8. A discharge lamp discharge electrode, comprising: a wire coil having a plurality of layers disposed around an electrode rod, a first layer having turns which are wound with torsion, the torsion having the same direction as the direction in which the torsioned turns extend around said electrode rod so that said torsioned turns have a clamping fit with said electrode rod, and successive layers having turns which are wound in a direction opposite to the direction of the turns in the preceding layer, each successive layer having turns which are wound with torsion, the torsion of each successive layer having the same direction as the direction in which said torsioned turns of each successive layer extend around the electrode rod so that said torsioned turns in each successive layer provide a clamping fit between said torsioned turns of each successive layer and the preceding layer.

9. A discharge lamp discharge electrode as claimed in claim 8 wherein for each succeeding layer the amount of torsion in each torsioned turn is greater than the torsion of the torsioned turns of the preceding layer.

10. A discharge lamp discharge electrode as claimed in claim 8, wherein each layer has ends bounded by outermost turns and the two outermost turns at each end of each layer are wound without torsion.

11. A discharge lamp discharge electrode as claimed in claim 10, wherein said electrode rod comprises mainly tungsten and said wire coil comprises mainly tungsten.

* * * * *